United States Patent [19]

Jennings

[11] Patent Number: 4,468,212

[45] Date of Patent: Aug. 28, 1984

[54] METHOD OF NESTING MULTIPLE PAPERBOARD CARTON BLANKS

[75] Inventor: Frederick R. Jennings, Cupertino, Calif.

[73] Assignee: Pneumatic Scale Corporation, Quincy, Mass.

[21] Appl. No.: 292,658

[22] Filed: Aug. 13, 1981

Related U.S. Application Data

[62] Division of Ser. No. 113,487, Jan. 21, 1980, Pat. No. 4,300,716.

[51] Int. Cl.[3] ..... B31B 1/74; B31B 1/16

[52] U.S. Cl. ..... 493/52; 493/56

[58] Field of Search ..... 83/32, 48, 56; 229/DIG. 9, 44 CB, 37 R; 493/56, 55, 340, 52

[56] References Cited

U.S. PATENT DOCUMENTS

| | | | |
|---|---|---|---|
| 547,938 | 10/1895 | Pusey | 229/DIG. 9 |
| 2,033,994 | 3/1936 | Mulligan | 229/DIG. 9 |
| 2,601,530 | 6/1952 | Kegan et al. | 229/DIG. 9 |
| 3,003,675 | 10/1961 | Ringler | 229/DIG. 9 |
| 3,985,287 | 10/1976 | Stetler | 229/DIG. 9 |

*Primary Examiner*—James F. Coan

*Attorney, Agent, or Firm*—Knobbe, Martens, Olson & Bear

[57] ABSTRACT

A one-piece T-shaped carton blank is disclosed which is utilized to form a rectangular cross-sectional container having its top and bottom end panels sealed in a plane substantially perpendicular to its sidewalls. The carton blank is formed having a definite dimensional relationship between its end panels and side panels to provide improved nesting of multiple carton blanks upon paperboard sheet stock in an alternating inverted side-by-side relationship. A pair of end sealing tabs extend along the top and bottom edges of the blank side panels. One of the end sealing tabs is separated from the top end panel and from a side sealing tab to prevent tearing and to permit the complete welding of the side sealing tab up onto the top end closure panel of the carton blank. This separation of the end sealing tab in combination with displacement of the hinge line of the top end closure panel downward provides a liquid-tight corner seal for the carton. Further, an improved method of scoring and bending of the carton blank is provided.

3 Claims, 16 Drawing Figures

Fig. 5a (PRIOR ART)
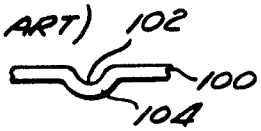
Fig. 5c
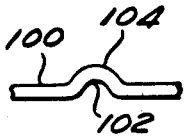
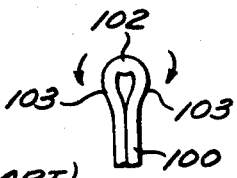
Fig. 5b (PRIOR ART)
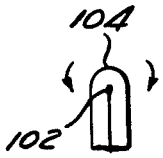
Fig. 5d
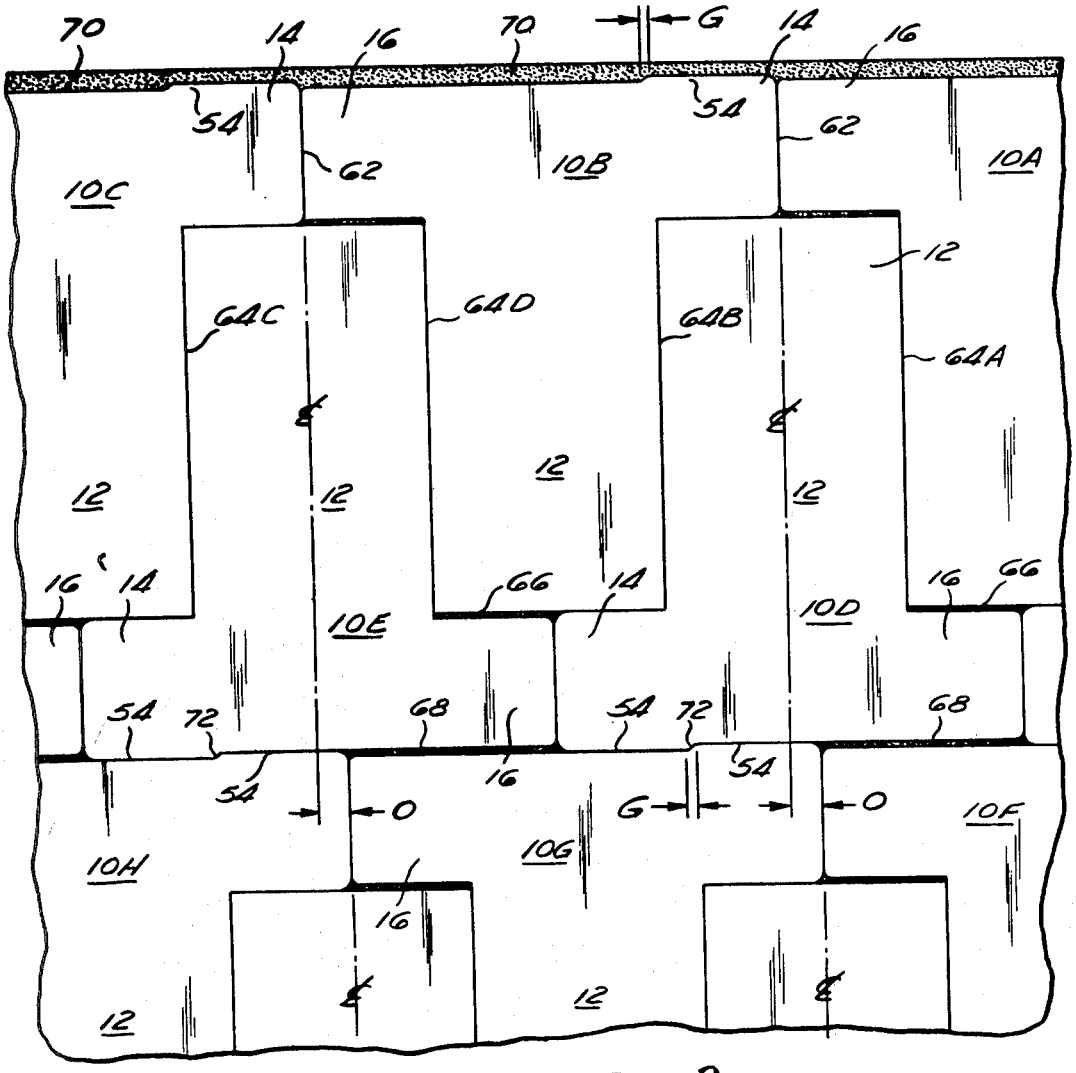
Fig. 2

METHOD OF NESTING MULTIPLE PAPERBOARD CARTON BLANKS

This application is a division of application Ser. No. 113,487, filed Jan. 21, 1980 now U.S. Pat. No. 4,300,716.

BACKGROUND OF THE INVENTION

The present invention relates to paperboard containers for potable liquid and more particularly to rectangular cross-sectional containers formed from a one-piece substantially T-shaped blank of polyethylene coated paperboard. Such containers are generally of the type shown in U.S. Pat. No. 3,749,330, granted July 31, 1973, to Charles W. Jones, U.S. Pat. No. 4,084,489, granted Apr. 18, 1978, to Matovich, Jr., and U.S. patent application Ser. No. 911,900, filed June 2, 1978, by Josef Buschor. The distinguishing characteristics of these cartons are their inclusion of a straw element within the interior of the carton blank which, during opening of the carton, may be rotated to expose one end of the straw element from which the contents of the carton may be drawn, and the deposition of the top and bottom end panels of the carton substantially perpendicular to the sidewalls. Such characteristics provide convenience and sanitary usage of the contents of the container while permitting more efficient use of paperboard material and yielding improved carton stacking for shipment.

Although these containers have provided a significant improvement over prior art gable top container designs, they have possessed certain structural and fabrication deficiencies which have prevented their widespread use in the industry. These deficiencies have focused upon material loss or waste in the nesting of multiple carton blanks upon the sheet stock from which they are derived, a tendency for leakage at the top corner seals of the carton, and damage to the carton blank paperboard during the scoring and bending of the carton blank.

With reference to the material wastage during fabrication of the carton blanks, the prior art, such as Matovich, Jr., U.S. Pat. No. 4,084,489, has disclosed a carton blank in which the width across the side panels and end sealing tabs has been substantially greater than the combined width of the end closure panels. This dimensional relationship has required the carton blanks to be nested upon the sheet stock from which they are produced, in a manner whereby the carton blanks are separated from one another. By such separation, voids are formed between adjacent carton blanks upon the sheet stock, which results in substantial sheet stock waste and decreases machine cutting speed operation.

The corner leakage tendency of the prior art cartons has been caused primarily due to the inclusion of V-shaped notches upon the sealing tabs of the blank which has resulted in the raw cut edges of the sealing tab being located at the corner junctions of the side panels with the end closure panels of the container. These raw cut corners are subject to being wetted by the contents of the carton and yield small discontinuities in the sealing surfaces which has been found to prohibit the effective sealing of the end closure panels thereto. Thus, the prior art carton has been subject to moderate leakage at the top corner junctions between the end panels and side panels.

Additionally, the prior art carton blank design has heretofore prohibited the side sealing tab from being sealed onto both the top and bottom end closing panels of the carton. As such, during the subsequent end sealing operation of the end closure panels to the side panels, a small inconsistency or flow channel has been present in the corners of the carton adjacent the end panel/-side sealing tab junction which often allowed small amounts of the contents of the carton to be released during shipping and handling.

To facilitate formation of the carton, the prior art carton blank has been pre-scored to provide preferred bending lines about which the carton is articulated. Heretofore, the bending of the carton blank was accomplished in a direction away from the scoring line, i.e., such that the carton blank breaks away from the score lines. This bending produced a bulging effect at the corners of the container and resulted in the rupturing of the paperboard fiber during the bending process which detracted from the overall appearance of the container, as well as oftentimes fracturing the polyethylene coating of the carton blank making the container subject to absorbtion of the contents therein.

Thus, there exists a present need in the art for a carton blank wherein material wastage is maintained at a minimum, the corner areas of the carton are eliminated from raw cut edges, and the scoring and bending of the carton blank is adapted to eliminate rupturing of the fibers of the paper stock material.

SUMMARY OF THE PRESENT INVENTION

The present invention comprises a carton blank and an improved method of forming a carton of the type hereinbefore identified, which significantly eliminates the structural and fabrication deficiencies of the prior art. Particularly, the carton blank of the present invention and carton formed therewith, is specifically designed to obtain maximum content volume with a minimum usage of paperboard stock. In this regard, the carton blank of the present invention is formed having a definite dimensional relationship between the side panels and sealing tabs of the carton blank to the end closure panels which permits multiple carton blanks to nest together in an inverted side-by-side orientation upon the paperboard stock and be cut therefrom, with a minimum of material scrap and a maximum cutting machine operation speed. As such, an optimum number of carton blanks may be produced from the paperboard sheet stock using existing machine technology.

In addition, the present invention eliminates the V-shaped notches previously formed on the sealing tabs of the carton blank. Rather, the sealing tabs of the carton blank of the present invention are formed continuous throughout their length and diagonally scored in the vicinity of the corner folds of the side panels, thereby being adapted to be folded inward to reside within the interior of the carton. By such a design, the end closure panels may be sealed directly to the unbroken perimeter edges of the sealing tabs even in the sidewall corner areas of the container, rather than upon the raw edges heretofore utilized in the prior art. It has been found that such corner formation greatly increases the strength of the seal in the corners of the container, thus yielding a liquid-tight carton.

Further, in the present invention, the side sealing tab is relocated upon the opposite end of the carton blank (compared to that disclosed in Matovich, Jr., U.S. Pat. No. 4,084,489, and is increased in length over the Prior art configuration to extend partially onto both end closure panels. By such a configuration, the side sealing tab may be sealed throughout its full length and onto both the top and bottom closing panels which, during the subsequent sealing of the end closure panels to the side panels, has been found to eliminate the rear corner leakage experienced in the prior art designs.

In contradistinction to the methods heretofore utilized throughout the industry, the present invention contemplates the novel method of forming scoring lines upon the interior of the carton blank and subsequently bending the carton blank to break into the score line. This inside breaking of the carton blank eliminates the unsightly bulging effect at the corners caused by the rupturing of the fiber of the paperboard stock and yields a crisp corner wherein the fibers of the paper stock are compressed within the score line.

In addition, the present invention discloses a displaced hinge line for the top end closure panel of the carton which further eliminates the tendency of the carton to leak in its rear corners, as well as discloses alternative embodiments for the actual carton produced by the improved carton blank of the present invention which are specifically suitable for various liquid and powdered contents.

DESCRIPTION OF THE DRAWINGS

These and other features of the present invention become more apparent upon reference to the figures wherein:

FIG. 2 is a plan view of a portion of the sheet stock web from which the carton blank of FIG. 1 is derived showing the improved nesting of multiple carton blanks thereon;

FIG. 5A is a cross-sectional view of a portion of a carton blank illustrating the formation of a scoring line heretofore utilized in the prior art;

FIG. 5B is a cross-sectional view of the prior art method of bending of the carton blank of FIG. 5A about the scoring line;

FIG. 5C is a partial cross-sectional view of a portion of a carton blank illustrating the formation of a scoring line thereon as utilized in the present invention;

FIG. 5D is a cross-sectional view of the present invention's method of bending of the carton blank of FIG. 5C about the scoring line;

DETAILED DESCRIPTION OF THE PREFERRED EMBODIMENT

Figure 1:
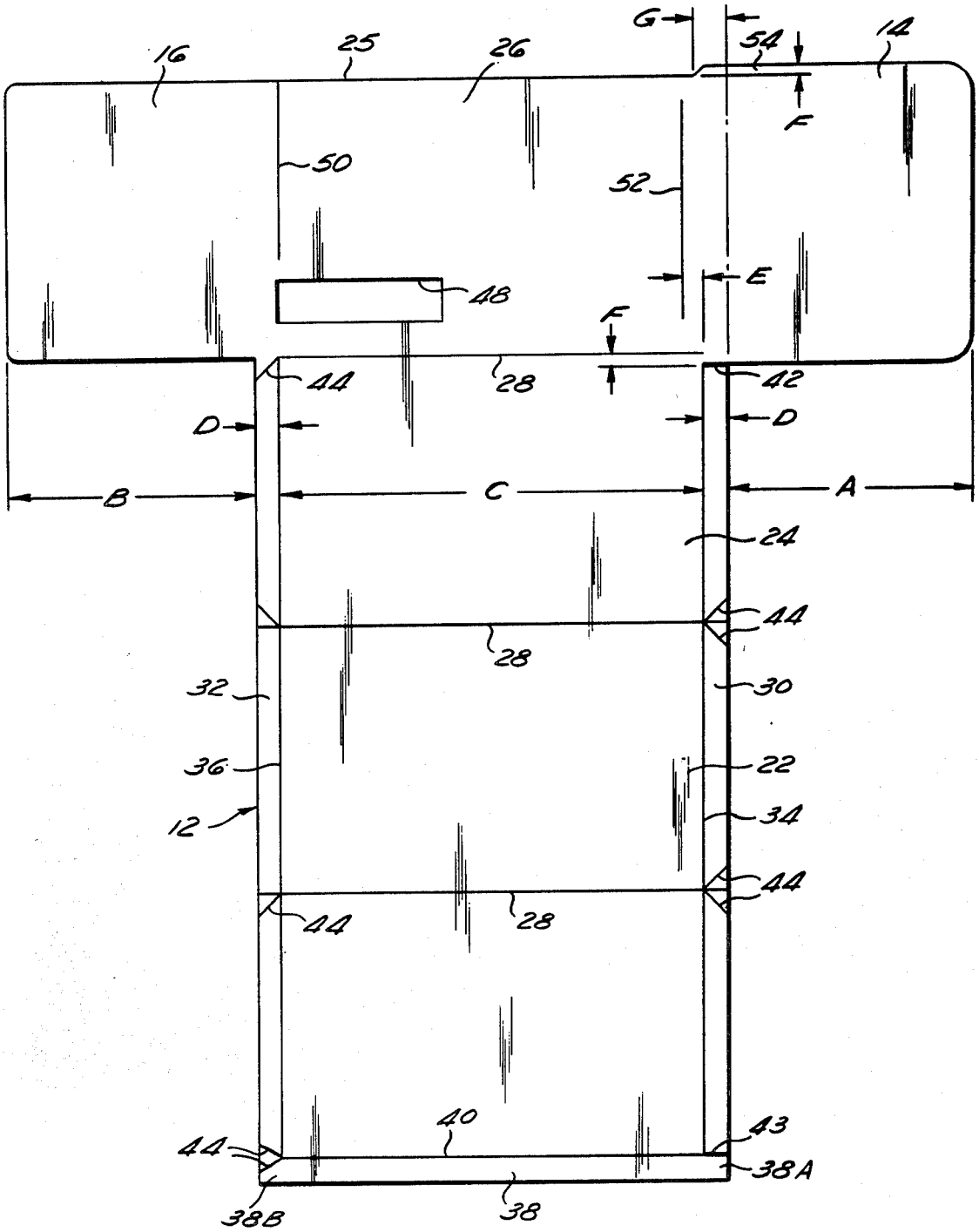
FIG. 1 is a plan view of the improved carton blank of the present invention illustrating its preferred configuration and the location of the scoring lines thereon.

Referring to FIG. 1, there is shown the carton blank 10 of the present invention preferably formed from thin paperboard stock, coated with a layer of polyethylene material which is impervious to the contents to be placed in the container. The carton blank 10 is formed in substantially T-shaped configuration having an elongate central portion 12 and a pair of end panels 14 and 16 which are integrally connected to the elongate section 12 adjacent one end thereof.

The elongate section 12 is composed of four sidewall panels 20, 22, 24, and 26, which are delineated by a plurality of scoring lines 28 extending transversely across the section 12. These scoring lines 28 are preferably formed as indentations on the side of the carton blank 10 which will subsequently form the interior surfaces of the container, and selectively weaken the carton blank to yield preferential folding lines about which the carton blank may be articulated.

A pair of end sealing tabs 30 and 32 extend continuously along the opposite end edges of the side panels 20, 22, and 24 and are formed by the respective scoring lines 34 and 36. The side panel 20 is additionally provided with a side sealing tab 38 at its distal edge, formed by the scoring line 40 which extends throughout the length of the side panel 20. In the preferred embodiment, the end sealing tab 32 is integrally connected at its opposite ends to the end closure panel 16 and side sealing tab 38, whereas the end sealing tab 30 is separated or severed from the end closure panel 14 and side sealing tab 38 by cuts or slits 42 and 43, respectively, extending throughout the height of the end sealing tab 30.

Each of the end sealing tabs 30 and 32 are provided with a plurality of diagonally extending score lines 44 which initiate at the intersection of the scoring lines 28 with the scoring lines 34 and 36, respectively, and terminate at the distal edge of the sealing tabs 30 and 32. As shown, these diagonal scoring lines 44 on the end sealing tab 32, are formed only on the side panels 20 and 24, whereas for the end sealing tab 30, they are provided on each of the side panels 20, 22, and 24. Finally, the side panel 26 may additionally be provided with an aperture 48 which provides access to the interior of the carton, and sealingly receives the straw element and tape length (shown in FIG. 6A).

The end panels 14 and 16 are integrally connected to the side panel 26 at opposite ends thereof, and are formed in a generally square configuration. The end closure panel 16 is delineated from the side panel 26 by a scoring line 50 which extends from the edge 25 of the side panel 26 terminating at a location spaced from the aperture 48, and is aligned with the scoring line 36 forming the end sealing tab 32. The end closure panel 14 is delineated from the side panel 26 by a scoring line 52 which extends only through the central portion of the side panel 26 terminating short of the edge 25 and short of the scoring line 28 formed between the side panels 26 and 24. As will be noted, the scoring line 52 is not aligned with the scoring line 34 which forms the end sealing tab 30, but rather is displaced inwardly a short distance E along the length of the side panel 26. The end closure panel 14 is additionally formed slightly larger in size than the end panel 16 extending a short distance F outward beyond the edge 25 and score line 28 of the side panel 26. The oversized portion of the end panel 14 extending beyond the edge 25 of the carton blank forms a protruding section 54, the length of which extends inboard beyond the edge of the sealing tab 30 represented by the distance "G" in FIG. 1.

In the preferred embodiment, a definite dimensional relationship is maintained between the length "A" and "B" of the end panels 14 and 16 to the length "C" of the side panels 20, 22, 24, and 26 and the length "D" of the end sealing tabs 30 and 32. In particular, the carton blank 10 is formed such that the sum of the distances A and B which the end panels 14 and 16, respectively, extend beyond the edges of the end sealing tabs 30 and 32, is equal to the sum of the length dimension C of the side panels 20, 22, 24, and 26, and the height dimension D of each of the end sealing tabs 30 and 32. That is, $A+B=C+2D$. By this particular dimensional relationship, the carton blank 10 may be nested and cut from a web of sheet stock material with minimum material wastage yielding optimum utilization of material stock.

The improved nesting characteristics made possible by the carton blank 10 of the present invention may be seen upon reference to FIG. 2 wherein a plurality of carton blanks 10 are disposed in a patterned array upon a web of sheet stock material 60. The carton blanks 10 are preferably arranged in a plurality of horizontally extending rows, e.g., in FIG. 2, blanks 10A, 10B and 10C being in one row, while blanks 10D and 10E are in a second row, and blanks 10F, 10G, and 10H are in a third row. Adjacent carton blanks 10A, 10B, and 10C, in each row, are disposed in a side-by-side orientation with their respective end closure panels 14 and 16 abutted along a single cutting line 62.

As shown, the carton blank rows are arranged vertically along the sheet stock 60 to form a plurality of nested pairs of rows, with the second carton blank row in each pair (comprising carton blanks 10D and 10E in FIG. 2) being inverted with respect to the first carton blank row (comprising blanks 10A, 10B, and 10C). As such, adjacent carton blanks 10A, 10D, 10B, 10E, and 10C in each pair of rows are alternatively upright and inverted along the web of sheet stock 60.

Due to the combined width (C and 2D) of the side panels 20, 22, 24, and 26 and sealing tabs 30 and 32 being equal to the combined width of the end closure panels (A and B), the elongate sections 12 of each of the carton blanks 10 arranged in the inverted rows, abut each other along the lines 64A and 64B, 64C and 64D, which may be referred to as an abutment axis.

In addition to the inverted alternative row orientation of the carton blanks, each horizontal pair of rows is positioned upon the web 60 such that the protruding portions 54 of the end closure panels 14 in the second inverted row of one pair abut the protruding portions 54 of the first row in the next pair along a common diagonal edge 72. This abutment at the edge 72 causes each pair of rows to be horizontally offset or staggered from the next pair of rows by a distance "O" equal to twice the distance "G" that the protruding section 54 extends inward beyond the edge of the sealing tabs 30.

By this alternate inverted row and offset carton blank nesting pattern, the carton blanks 10 lie tightly nested in a side-by-side orientation thereby eliminating the substantial voids formed on the sheet stock 60 by the prior art carton blank configurations. As such, the scrap material on the web 60 of the present invention consists only of the minimal material 66 and 68 lying adjacent the end closure panels 16 of each of the carton blanks 10 which represents the size differential "F" (FIG. 1) between the end closure panels 14 and 16 as well as a small border section 70, formed along the edges of the webbing 60 which can be reduced substantially to nothing by proper selection of the web size. Considering that the carton blanks 10 form non-reusable containers, and will typically be supplied in vast quantities, such savings in the amount of scrap or waste material from the web of sheet stock 60 is very important from the standpoint of overall cost effectiveness of the carton.

As will be recognized, by the specific nesting configuration depicted in FIG. 2, the individual carton blanks 10 may be fabricated from a roll stock webbing 60 with a minimum of material wastage as well as a minimum of cuttings upon the sheet stock. Thus, as the webbing 60 is fed into one of the well-known stamping apparatus (not shown), a maximum number of carton blanks may be produced for a particular webbing and machine operational speed.

Figure 3:
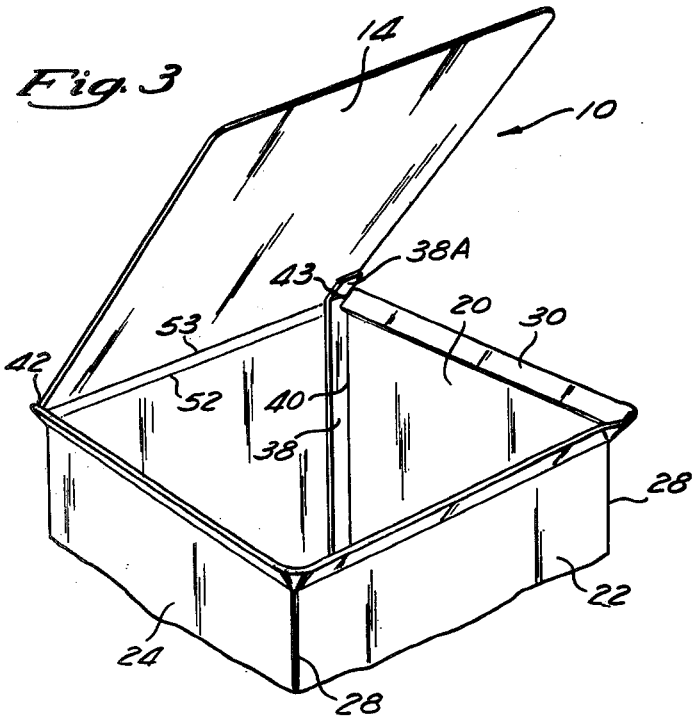
FIG. 3 is an enlarged perspective view of the top end portion of the carton formed from the carton blank of FIG. 1 with the top end closure panel raised above the continuous sealing tab.

Referring to FIG. 3, the improved sealing characteristics made possible by the carton blank 10 of the present invention will now be described. As will be recognized, the carton depicted in FIG. 3 is formed from the carton blank 10 by a series of folding, bending, and sealing steps. The first of these steps is the bending of the side panels 20, 22, 24, and 26 about the scoring lines 28 as well as the bending of the side sealing tab 38 about the scoring line 40 to reside on the interior surface of the side panel 26. Once in the configuration, the side sealing tab 38 may be sealed as by way of the application of heat, to the interior of the side panel 26 thereby maintaining the open ended square tubular configuration, depicted in FIG. 3.

It is an important feature of the carton blank 10 of the present invention that the side sealing tab 38 is bonded or sealed throughout its entire length including the small portion 38A which extends upward onto the interior surface of the top end closure panel 14 and a corresponding small portion 38B (FIG. 1) which similarly extends onto the interior surface of the bottom end closure 16. In the preferred embodiment, the side sealing operation is performed on an interior mandrel (not shown) which is additionally utilized to permit the bottom end closure panel 16 (not shown in FIG. 3) to be sealingly bonded across the lower end sealing tab 32 (FIG. 1) which has been previously folded inward the end closure panel 16 thus forming the bottom surface (not shown) of the carton 10. The apparatus and method for forming the carton blank 10 into such a configuration is disclosed in U.S. Pat. application Ser. No. 058,481, filed July 18, 1979, by the same applicant entitled METHOD AND APPARATUS FOR FORMING A CONTAINER FOR LIQUIDS, the disclosure of which is expressly incorporated herein by reference. It should be recognized that the size differential between the bottom and top end closure panels 16 and 14, respectively, the differing locations of the diagonal scoring lines 44 on the bottom and top sealing tabs 32 and 30, and the inclusion of the slits 42 only on the top sealing tabs 30, are specifically designed to augment the interior mandrel sealing of the bottom end panel 16 as opposed to the exterior mandrel sealing of the top end panels 14, since the many structural and formational problems encountered in exterior mandrel sealing are not present in interior mandrel sealing.

Figure 4:
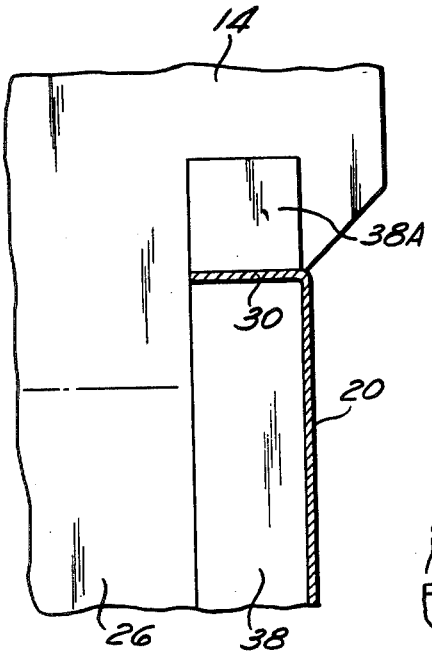
FIG. 4 is an enlarged partial cross-sectional view of the upper rear corner of the carton of FIG. 3 depicting the orientation of the end closure panel, side panel, end sealing tab, and side sealing tab prior to the end sealing process.

Subsequent to the side sealing and bottom end sealing of the carton blank 10, the top end sealing tab 30 is folded over to reside within the interior of the square tubular carton configuration and extend generally perpendicular to the upper portion of the side walls 22, 24, and 26 (shown in FIG. 4). Due to the top end sealing tab 30 being separated from the end closure panel 14 and side sealing tab 38 by the cuts or slits 42 and 43 (FIG. 3), the sealing tab 30 may be folded over throughout its length without tearing and without disturbing the seal between the end closure panel 14 and the upper portion 38A of the side sealing tab 38.

Figure 4A:
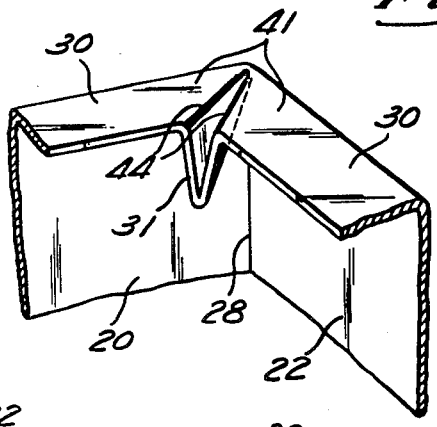
FIG. 4A is a partial perspective view of one of the forward corners of the carton blank produced from the carton blank of FIG. 1 depicting the inward folding of a portion of the continuous end sealing tab.

As shown in FIG. 4A, during this fold-over process, the diagonal score lines 44 formed at the intersection of the sealing tab 30 with the corner-forming score lines 28, permit the portion 31 of the sealing tab 30 lying between adjacent diagonal score lines 44 to be pushed inward below the main plane of the sealing tab 30. By such a design, the top sealing tab 30 is maintained continuous throughout its length having a miter-like interface 41 at its corner junctions with the sidewalls 20, 22, and 24. With this miter-like interface, the present invention eliminates the prior art's raw cut edge in the immediate vicinity of the corner junction of the sealing tab 30 which heretofore was subject to being wetted by the contents of the container and substantially weakened the top end seal.

Figure 4B:
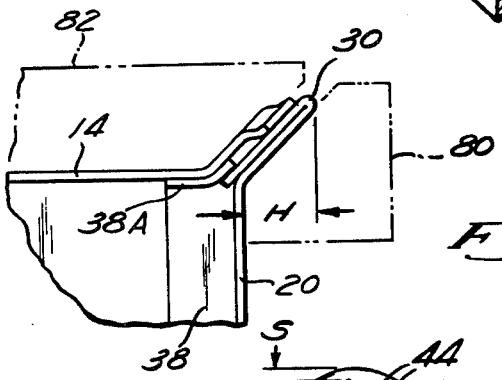
FIG. 4B is an enlarged partial cross-sectional view of the upper rear corner of the carton blank of FIG. 3 illustrating the configuration of the junction of the end closure panel, side panel, end sealing tab, and side sealing tab subsequent to the end sealing process.
Figure 4C:
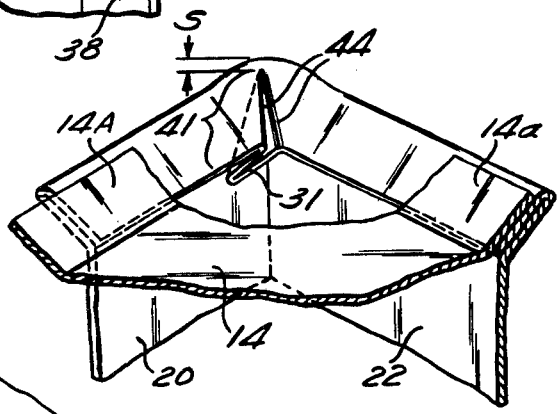
FIG. 4C is a partial perspective view of the forward corner of the carton blank in FIG. 4A depicting its configuration subsequent to the end sealing process.

Subsequent to the inward folding of the sealing tab 30, the sealing tab 30, as well as the extreme upper portion of the sidewalls 20, 22, and 24, are beveled outward to lie exteriorly of the remaining portion of the sidewalls 20, 22, and 24 through a short distance of approximately ⅛ of an inch (designated by the distance "H" in FIG. 4B). As will be recognized, this outward beveling is accommodated in the vicinity of the forward corners of the carton by the sealing tab 30 and the upper portion of the sidewalls of the carton stretching outward due to an internal thinning flow of the paperboard carton material. As shown in FIG. 4C, this thinning flow causes the miter-like interface 41 to be inwardly spaced by a distance S from the outermost edge of the forward corners, which, as will be explained in more detail below, permits an effective top seal to be formed across the sealing tab 30, even in the vicinity of the forward corners of the carton blank. Additionally, this outward beveling permits the upper end of the carton blank 10 to be supported by an exterior mandrel 80 (represented by the phantom line in FIG. 4B) which may be positioned along the three sides of the carton blank 10 corresponding to the side panels 20, 22, and 24. Additionally, as shown in FIG. 4B, during this beveling process, the portion of the sealing tab 31, lying between the diagonal score lines 44, is folded further beneath the sealing tab 30, assuming a position generally parallel to the angular plane of the sealing tab 30 located on the side panel 20.

With the carton blank 10 supported against the exterior anvil 80, the top end closure panel 14 may be forced downward to lie in a plane substantially perpendicular to the open end of the carton blank 10 as by way of a die 82 (represented by the phantom lines in FIG. 4B). By the application of this downward force, the perimeter edges 14A of the end panel 14 are beveled angularly upward between the die 82 and the anvil 80 to extend along and overlay the length of the sealing tab 30, wherein they may be sealingly bonded thereto by the application of heat. Further, due to the miter-like interface 41 being spaced from the outer edge of the sealing tab 30 (shown in FIG. 4C), a portion of the perimeter edges 14A of the end closure panel 14 extends outward beyond the interface 41 to positively seal against the sealing tab 30 and close off the interface 41 thereby significantly reducing the possibility of forward corner leakage.

Figure 4D:
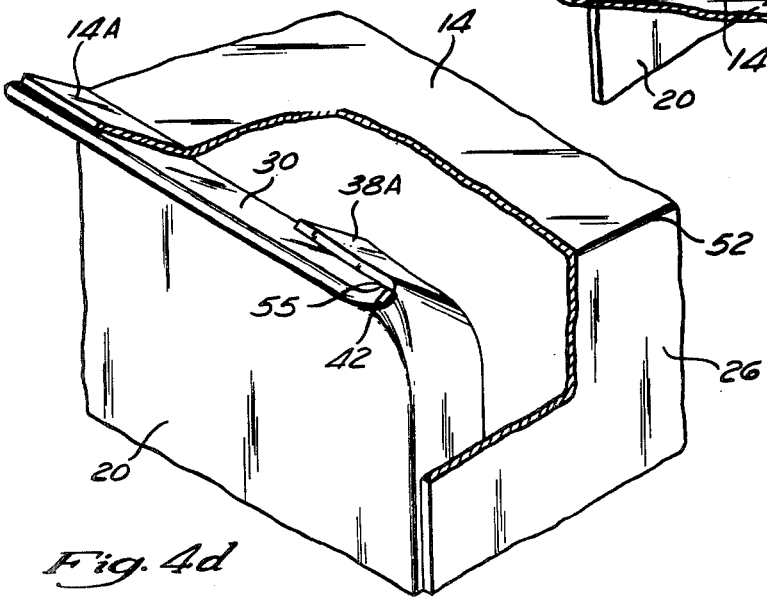
FIG. 4D is an enlarged perspective view of the carton formed from the carton blank of FIG. 1 showing the displaced hinge line of the top end closure panel.

Referring conjunctively to FIGS. 3 and 4D, it is shown that during the fold-over and end closure panel 14 sealing process, the end closure panel 14 pivots about the scoring line or actual hinge line 52 which, as previously mentioned, is displaced or dislocated downward along the length of the sidewall panel 26 from its natural or apparent hinge line 53 (represented by the phantom lines in FIGS. 3 and 4D). Due to this displacement, the natural hinge line 53 is positioned forward and above the relatively broad sealing surface of the end sealing tab 30. Additionally, the slits 42 and 43 located at the intersection of the top end sealing tab 30 with the end closure panel 14 are forced forward to be displaced from the actual rear corner of the carton and lie upon the sealing tab 30. As such, the slits 42 and 43 may be tightly "closed off" between end closure 14 and sealing tab 30 by the pressure exerted between the anvil 80 and die 82 during the end sealing procedure.

Additionally, due to the upper portion 38A of the side sealing tab 38 being previously sealed onto the end closure panel 14 during the fold-over procedure, the portion 38A overlays the cut or slit 42 formed on the sealing tab 30. Thus, the raw cut edge of the cut or slit 42 is covered by the continuous length of the portion 38A which extends from the sidewall panel 26 onto the end sealing tab 30.

By this particular top end carton arrangement, the application of heat during the sealing process causes all of the elements located in the right rear corner (as viewed in FIG. 3), i.e., the sealing tab 30, perimeter edge 14A, upper portion 38A, and the upper end of the sidewall 20, to be sealingly joined together.

Additionally, due to the end sealing tab 30 being continuous throughout its length and including the miter-like interface 41 (FIG. 4C) at the top frontal corners of the carton, a liquid-tight seal between the perimeter edge 14A of the end closure panel 14 and the sealing tab 30 may be facilitated. As such, the top seal leakage tendencies of the prior art flat top cartons is substantially eliminated.

In addition to the improved sealing capabilities made possible by the improved carton blank 10, the present invention additionally discloses a novel method of scoring and bending of the carton blank which produces a crisp corner and eliminates damage to the carton blank during fabrication.

In FIGS. 5A and 5B, an enlarged, partial cross-sectional view of the method of scoring (FIG. 5A) and bending (FIG. 5B) a carton blank 100 in the prior art is depicted. As shown, the carton blank 100 is scored by an indentation 102 which produces a corresponding protrusion 104 on the reverse side of the carton blank 100. Subsequently, the carton blank 100 is bent away from the scoring line 102 in a direction indicated by the arrows in FIG. 5B, yielding a corner configuration similar to that shown in FIG. 5B. As will be recognized, in this configuration, the corner bulges outward at 103 beyond the exterior plane of the carton blank 100 due to the internal fibers of the carton blank material rupturing upon encountering the tension exerted during the bending process. This rupturing of the fibers substantially weakens the carton blank 100 at the area of the bend and, in severe instances, causes a fracturing of the polyethylene material on the interior of the corner thereby subjecting the carton blank to absorbtion of the fluid contents.

In contradistinction, the present invention contemplates the scoring and bending of the carton blank 100 in a manner depicted in FIGS. 5C and 5D wherein the scoring line 102 is formed on the opposite surface (i.e., the surface that will form the interior of the carton) of the carton blank 100 yielding an attendant protrusion 104 on the exterior side of the blank. Subsequently, the carton blank 100 is bent inwardly about the score line 102 in the direction indicated in FIG. 5D. By this procedure, the corner is formed substantially, as shown in FIG. 5D, with the internal fibers of the carton blank material being compressed to reside within the indentation 102 while the outer corner configuration assumes the general preformed curvature of the protrusion 104. As such, a more crisp corner is provided which additionally eliminates the weakening of the carton blank 100 and the fracturing of the polyethylene coating material on the interior of the carton blank 100.

Figure 6A:
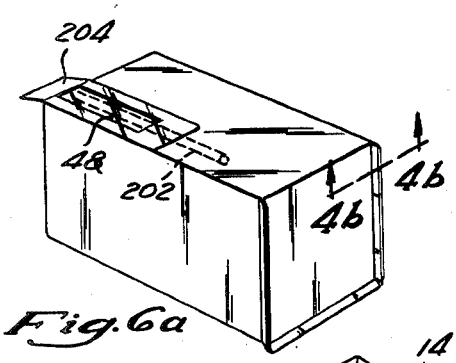
FIG. 6A is a perspective view of the carton produced with the preferred carton blank of FIG. 1 having a straw element and tape seal applied thereto.

In FIGS. 6A, 6B, 6C, and 6D, alternative embodiments of the container, derived from the carton blank 10 of the present invention, are shown. In FIG. 6A, a container 200 is shown which is fabricated from the carton blank 10, shown in FIG. 1. As shown, the aperture 48 positioned on the sidewall 26 is provided with the straw element 202 and sealingly covered by a length of tape 204. In this embodiment, the tape 204 is preferably formed from a Mylar strip which is coated on its undersurface by a film of polyethylene. Due to the different melting temperatures between Mylar and polyethylene, the tape length 204 may be heated to simultaneously seal against the exterior of the side panel 26 as well as a portion of the straw element 202. Subsequently, when a user desires to open the container 200, the end portion of the tape length 204 may be grasped by the user and be peeled or torn from the side panel 26 whereby the straw element 202 is rotated upward and in position to withdraw the contents from the container 200. As will be recognized, such a carton 200 is specifically suitable for pottable liquids such as milk or fruit juices which are conveniently packed in single serving sizes and disposable after usage. A more detailed discussion of the opening operations of such a carton is disclosed in U.S. patent application Ser. No. 911,990, filed June 2, 1978, by Joseph Buschor.

Figure 6C:
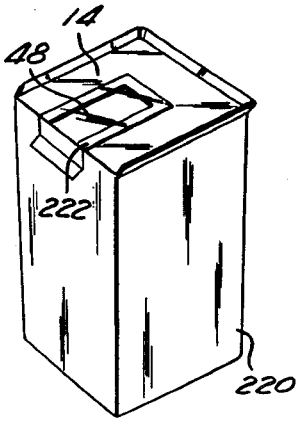
FIG. 6C is an alternative embodiment for a carton having a tape seal disposed on its top end closure panel.
Figure 6B:
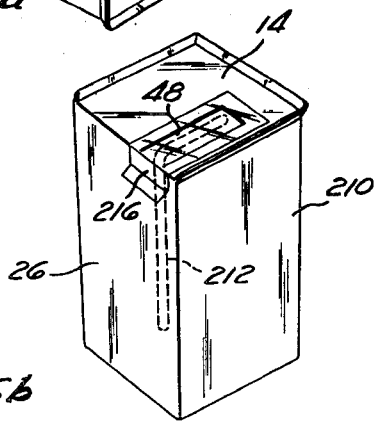
FIG. 6B is an alternative embodiment for a carton having a straw element and tape seal disposed on its top end closure panel.

In FIG. 6B, an alternative embodiment for the container of FIG. 6A is shown, wherein the aperture 48 is relocated upon the top end closure panel 14 and includes a straw element 212 disposed therein. In this embodiment, however, the straw element 210 is preferably sealed to the interior of the sidewall 26 and includes a resilient upper portion 214 which is disposed in a plane perpendicular to the remainder of the element. A length of tape 210 sealingly covers the aperture 48 and prevents the upper portion 214 of the straw element 212 from flexing outward from the container. In use, a user may peel off the tape length 216 from the end closure panel 214 thereby allowing the resilient upper portion 214 of the straw element 212 to spring upward from the container whereby a user may easily withdraw the liquid from the container 210 or alternatively remove the straw element 212 and utilize the aperture 48 as a pouring spout. As such, with the carton 210 depicted in FIG. 6B, a user may consume the contents directly from the carton 210 or alternatively pour the contents into a drinking glass or the like.

In FIG. 6C, an additional embodiment of a carton 200 formed by a carton blank 10 of the present invention is shown, wherein the aperture 48 is disposed centrally upon the top end closure panel 14. As in the other embodiments, the aperture 48 is sealed by a tape length 222 which is removable by the user. In this particular embodiment, however, the straw element has been eliminated with the aperture 48 being used exclusively as a pouring spout. This particular embodiment of the carton 220 is suitable for large size containers, such as that typically utilized in the industry for marketing quart and half-gallon sizes of milk.

Figure 6D:
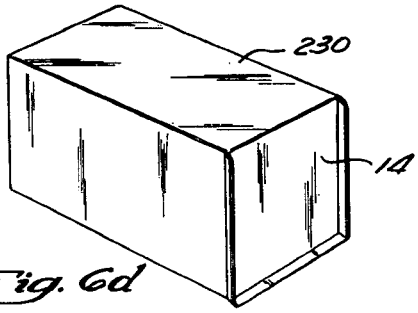
FIG. 6D is a perspective view of the carton of the present invention formed without a straw element or tape seal thereon.

Alternatively, in FIG. 6D, a carton 230 is disclosed wherein the aperture 48 has been completely eliminated. By this design, the carton blank 230 is specifically adapted for various dry products which preferably are maintained in a safety container which may not be easily opened by the user.

It will be understood that although the foregoing specification has disclosed particular materials from which the carton blank is fabricated, alternative materials may be utilized without departing from the spirit of the present invention. Also, while the description refers to certain orientation as the top and bottom, it will be evident that this is only for convenience in description and does not limit the orientation.

I claim:

1. A method of nesting multiple carton blanks upon a web of sheet stock from which said carton blanks are derived to optimize the utilization of sheet stock, each of said carton blanks have a substantially T-shaped configuration composed of an elongate central portion and a pair of end panels extending outward from one end of said elongate central portion with a protruding section on an end panel, said method comprising the steps of:

arranging a first group of carton blanks in a side-by-side orientation along the length of said web of sheet stock, opposite end panels of adjacent carton blanks within said first group being abutted along their outboard edges (62);

arranging a second group of carton blanks in a side-by-side orientation along the length of said web of sheet stock, opposite end panels of adjacent carton blanks within said second group being abutted along their outboard edges, said second group of carton blanks being inverted with respect to said first group of carton blanks; and interspersing said second group of carton blanks with said first group of carton blanks so that said elongate sections of each of said carton blanks in said second group lie between the elongate sections of an adjacent pair of carton blanks in said first group;

arranging third and fourth groups of carton blanks abutted and interspersed identically with said first and second groups; and abutting a first row of carton blanks formed by said first and second groups with a second row formed by said third and fourth groups such that said protruding sections on said end panels of one row interleave with the protruding sections of the second row.

2. The method of claim 1 wherein the elongate section of said second group of carton blanks abut the elongate sections of said first group of carton blanks along their outboard edges and wherein said protruding sections extend only partially along the edge of said end panel such that said first and second rows are offset with respect to each other by the interleaving of said protruding sections.

3. A method of nesting T-shaped carton blanks upon a web of sheet stock from which said carton blanks are derived, each of said carton blanks comprising an elongate central section with a sealing tab on each side and a pair of end panels, said end panels extending outwardly from opposite sides of one end of said elongate central section in a combined amount substantially equal to the width of said elongate central section and one said end panel having a protruding section extending from an outboard edge of said end panel inward to a point beyond the edge of said sealing tab by a predetermined distance, said method comprising the steps of:

arranging said carton blanks in a plurality of rows extending along the length of said web of sheet stock with adjacent carton blanks in each of said rows abutted along the outboard edges of their end panels;

inverting every other row of said carton blanks upon said web of sheet stock;

interspersing the elongate central sections of the carton blanks of said inverted rows between the elongate section of the carton blanks of a preceding non-inverted row so that each of said inverted rows intermeshes with a preceding one of said non-inverted rows to form a pair of rows, said carton blanks in each of said pairs of rows being alternately upright and inverted along the length of said web of sheet stock;

offsetting every interspersed pair of rows from its adjacent pair of interspersed rows such that said protruding sections interleave with each other thereby minimizing wasted paper stock.

* * * * *